US006722082B1

(12) United States Patent
Peterson et al.

(10) Patent No.: US 6,722,082 B1
(45) Date of Patent: Apr. 20, 2004

(54) WINDOW HAVING A HINGED WEATHERSTRIP

(75) Inventors: James L. Peterson, New Richmond, WI (US); Richard M. Fischer, Stillwater, MN (US); Thomas P. Coach, Osceola, WI (US)

(73) Assignee: Andersen Corporation, Bayport, MN (US)

( * ) Notice: Subject to any disclaimer, the term of this patent is extended or adjusted under 35 U.S.C. 154(b) by 0 days.

(21) Appl. No.: 09/605,501

(22) Filed: Jun. 28, 2000

(51) Int. Cl.[7] ..... E06B 7/22
(52) U.S. Cl. ..... 49/428; 49/429
(58) Field of Search ..... 49/428, 414, 429, 49/430, 161, 434, 415, 416, 455, 456, 457, 419, 475.1

(56) References Cited

U.S. PATENT DOCUMENTS 1,666,327 A * 4/1928 Dennis ..... 49/428
2,183,476 A 12/1939 Feiler
2,192,776 A * 3/1940 Robinson ..... 49/423
2,505,638 A 4/1950 Day (List continued on next page.)

FOREIGN PATENT DOCUMENTS

CA 872571 6/1971

OTHER PUBLICATIONS

Intek Better by Design, "Often Imitated, Never Duplicated", *Fenestration® The Magazine for the Window and Door Industry 21st Century*, 2 pages, Sep. 1999.

*Primary Examiner*—Gregory J. Strimbu
(74) *Attorney, Agent, or Firm*—Womble Carlyle Sandridge & Rice, PLLC

(57) ABSTRACT

A window having a frame, two fixed jamb liners, a sash, and two hinged weatherstrips. The fixed jamb liners are secured to the frame such that they do not move laterally with respect to the frame. The hinged weatherstrips include a rigid sash bearing member hingedly connected to a second member. The sash bearing member is capable of moving laterally toward and away from the fixed jamb liner such that it provides an effective seal between the sash and the fixed jamb liner.

9 Claims, 8 Drawing Sheets

U.S. PATENT DOCUMENTS 2,662,255 A * 12/1953 Serley et al. ..... 49/422
2,722,723 A 11/1955 Mears, Jr.
2,883,226 A 4/1959 Haynes
2,907,079 A 10/1959 Lundgren
2,912,726 A 11/1959 Goellner
2,939,170 A 6/1960 Lundgren
3,078,523 A 2/1963 Martin
3,145,433 A * 8/1964 Jones ..... 49/414
3,146,501 A 9/1964 Peters
3,269,062 A 8/1966 Mears, Jr.
4,034,510 A * 7/1977 Huelsekopf ..... 49/419
4,096,665 A * 6/1978 Ellingson ..... 49/475.1
4,134,234 A * 1/1979 Wood ..... 49/429
4,373,295 A 2/1983 Starck
4,551,881 A 11/1985 Hoffman
4,726,148 A 2/1988 Tix
5,027,557 A 7/1991 May
5,159,794 A 11/1992 Habbersett et al.
5,199,219 A 4/1993 Martini et al.
5,265,308 A 11/1993 May et al.
5,375,376 A 12/1994 Scott
5,526,608 A 6/1996 Stark
5,528,863 A 6/1996 Scott
5,566,507 A * 10/1996 Schmidt et al. ..... 49/428
5,592,782 A 1/1997 Scott
5,636,475 A 6/1997 Nidelkoff
5,671,566 A 9/1997 Tix et al.
5,675,937 A 10/1997 Stebel
5,699,636 A * 12/1997 Stark ..... 49/419
5,772,190 A 6/1998 May et al.
5,855,092 A 1/1999 Raap et al.
5,858,287 A 1/1999 Scott
5,887,392 A 3/1999 Martin
5,901,499 A 5/1999 Delaske et al.
6,122,864 A 9/2000 Martin
6,305,126 B1 * 10/2001 Hendrickson et al. ..... 49/456

* cited by examiner

FIG. 8
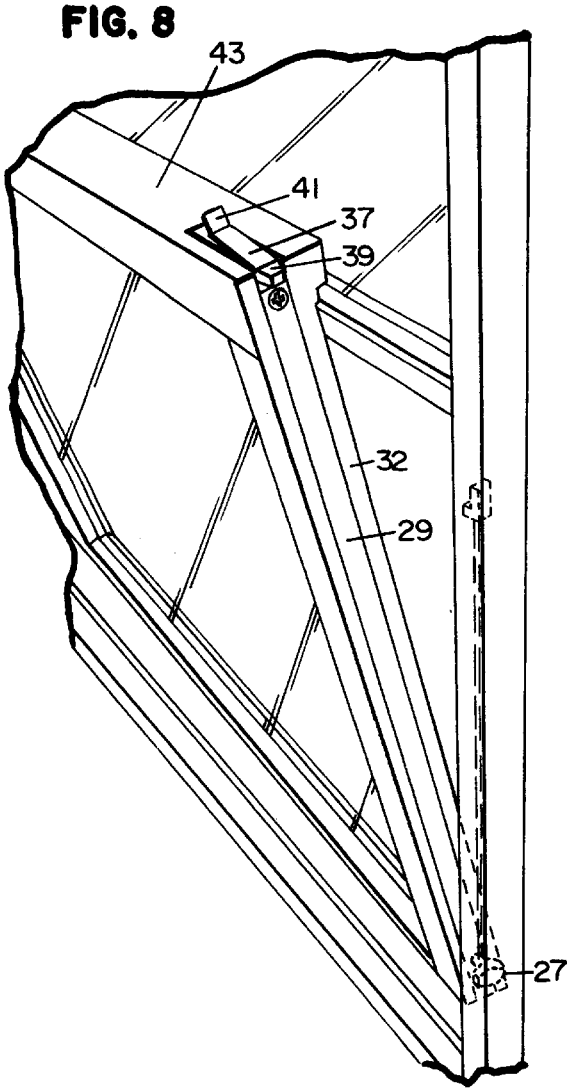
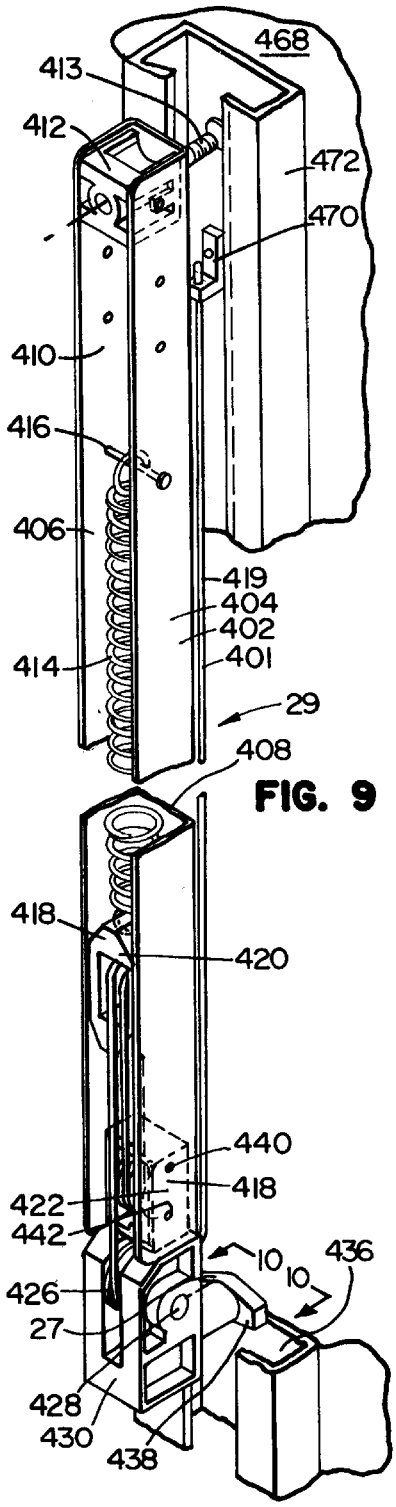
FIG. 9

WINDOW HAVING A HINGED WEATHERSTRIP

FIELD OF THE INVENTION

The invention relates to a window having a fixed jamb liner and a hinged weatherstrip. In particular, the window includes a frame, a pair of fixed jamb liners, a sash and a pair of hinged weatherstrips. The invention also relates to a fixed jamb liner and hinged weatherstrip assembly for use in a window.

BACKGROUND OF THE INVENTION

Hung windows are windows in which the sash rides vertically in the window frame. Oftentimes, a jamb liner provides an interface between a sash and a frame. In such a window the sash slides in the jamb liner. It is generally desired to prevent moisture and air from infiltrating from the outside of the window to the inside and yet to have good sliding motion of the sash.

Weatherstrips are used to reduce air and water infiltration between the sash and the jamb liner. Some prior art weatherstrips are made up of either a soft bulb type of weatherstrip or a pile weatherstrip. However, when these bulb weatherstrips are held in a fixed position (as opposed to part of a hinged weatherstrip as will be described below) they are not very durable and tend to wear out over multiple uses. Furthermore, these prior art bulb weatherstrips have a rather limited range of sealing effectiveness. If there is sufficient bow in the sash side member, the prior art weatherstrips may not effectively seal the entire length of the sash side member. The pile and soft bulb type of weatherstrips also result in a significant amount of friction which impedes the vertical movement of the sash within the jamb liner.

In many hung windows the sash can be tilted inward or outward such that the plane of the sash deviates from the plane of the frame. This tilting action allows for easy cleaning of the glass that is held in the sash.

In order for the sash in a tilt window to be tilted, the sash must be disengaged from the track of the jamb liner. The disengagement of the sash from the jamb liner is accomplished in many different ways. For example, in U.S. Pat. No. 5,566,507 a layer of polyurethane foam is situated between the frame and the jamb liner. The polyurethane foam acts as a spring so that the jamb liner can be pushed in an outward direction towards the frame, thereby disengaging from the sash. It has been found that sliding a sash in such a flexible jamb liner results in sluggish sliding interaction between the sash and the jamb liner.

SUMMARY OF THE INVENTION

A window having a frame, two fixed jamb liners, a sash, and two hinged weatherstrips is provided. The fixed jamb liners are secured to the frame such that they do not move laterally with respect to the frame. The hinged weatherstrips include a rigid sash bearing member hingedly connected to a second member. The sash bearing member is capable of moving laterally toward and away from the fixed jamb liner such that it provides an effective seal between the sash and the fixed jamb liner.

In accordance with another aspect of the invention, a fixed jamb liner and hinged weatherstrip assembly is provided.

BRIEF DESCRIPTION OF THE DRAWINGS

FIG. 8 is a perspective view of a preferred embodiment of a window of the invention including a balancer and latch.

FIG. 9 is a perspective view of an alternate preferred embodiment of a balancer and jamb liner of the invention.

DETAILED DESCRIPTION OF THE INVENTION

With reference now to various figures in which identical elements are identically numbered throughout, a description of a preferred embodiment of the present invention will now be provided. The present invention will be described with reference to a tilt window. A tilt window is a hung window in which the glass can be tilted into a plane that is different from the plane of the frame. This tilting operation allows for easy cleaning of the glass surfaces. While the invention is described in the context of a preferred embodiment, it will be appreciated that the invention includes numerous modifications.

A hung window includes a frame which includes at least two vertical frame jamb members. At least one sash slides vertically with respect to the two frame jamb members. In a preferred embodiment, the frame includes two vertical frame jamb members and two horizontal frame members to form a rectangular frame around an upper and a lower sash.

A sash is any structure which at least partially supports the moving glass of the window. A sash may include two vertical sash side members which are positioned in parallel relationship to the two vertical frame jamb members. In a preferred embodiment, the sash includes two vertical sash side members and two horizontal members to form a rectangular frame around an insulated glass unit.

Figure 1:
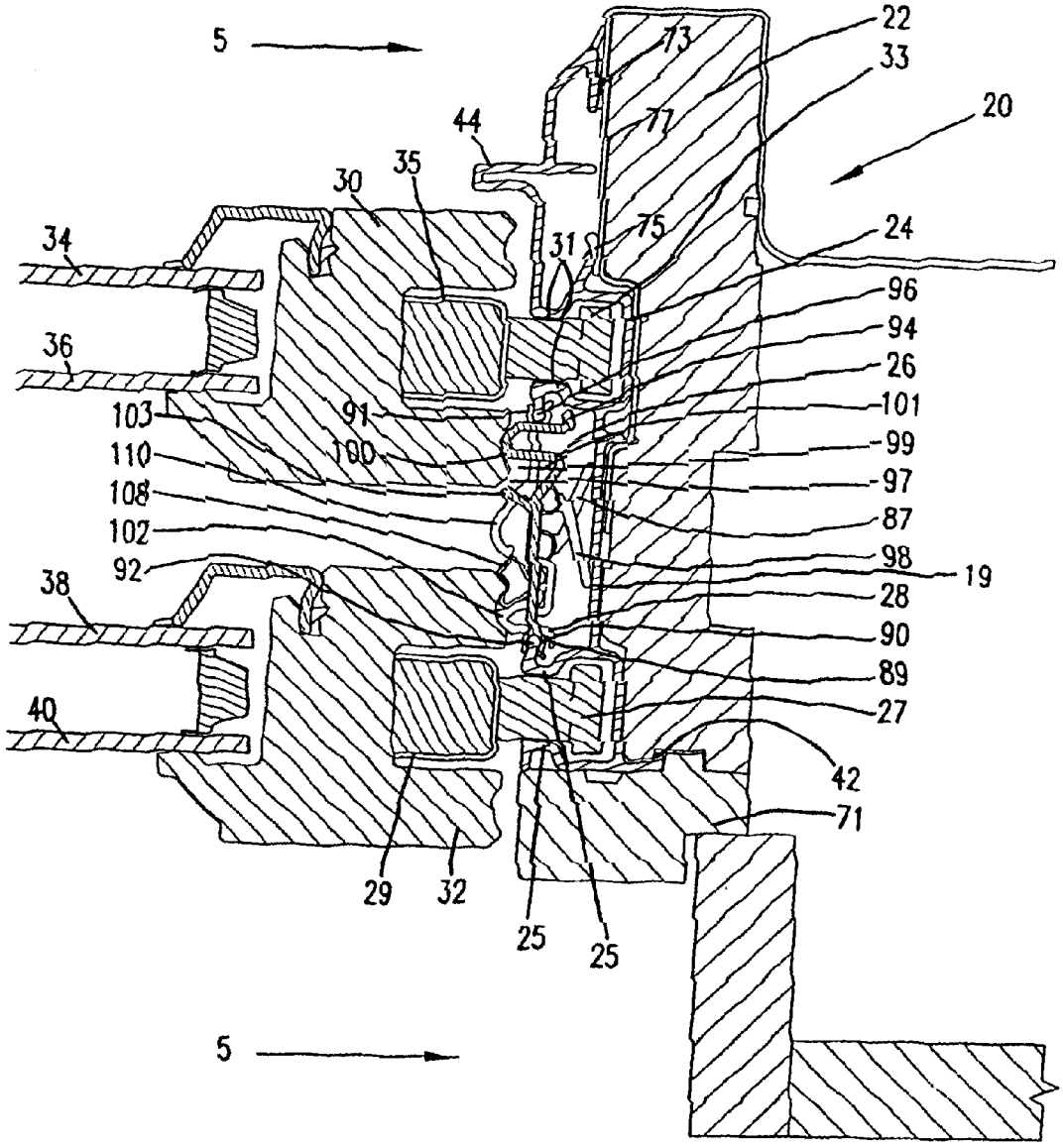
FIG. 1 is a cross sectional view of one side of a double hung window in a preferred embodiment of the invention.

Now referring to FIG. 1, the right side of a double hung tilt window 20 is shown from a top view. It should be appreciated that the left side of the window 20 is not shown. The left side of the window 20 as shown from the top view of FIG. 1, is a mirror image of the right side shown in FIG. 1.

The right side of the double hung tilt window 20 includes a frame jamb 22, a fixed jamb liner 24, two hinged weatherstrips 26 and 28, an upper sash side member 30 and a lower sash side member 32. Portions of glass panes 34, 36, 38 and 40 can also be seen in FIG. 1. The window 20 also includes balancers 29 and 35 secured to the sash side members 32 and 30 respectively. The in-sash balancers are discussed in detail in co-pending application Ser. No. 60/170,307 which is incorporated by reference herein.

A fixed jamb liner is a structure forming a track for guiding a hung sash side member in its vertical sliding motion, wherein the structure is fixed such that it is not movable in a direction toward or away from the frame to which the structure is secured or to be secured to.

A preferred embodiment of a fixed jamb liner is shown in FIG. 1. The fixed jamb liner may be secured to the frame jamb in any way that prevents lateral movement of the fixed jamb liner relative to the frame jamb. The fixed jamb liner 24 is secured to the frame jamb 22 by the friction fit of hook 42 between the frame jamb 22 and the inside stop 71. The fixed jamb liner 24 is additionally secured to the frame jamb 22 by double sided tape 73 and a continuous bead of silicone 75 between the vinyl skin 77 and the fixed jamb liner 24.

A track in a fixed jamb liner is any configuration that guides a sash during its sliding movement so as to prevent at least a point along the sash from tilting or otherwise moving out of the plane of its normal sliding operation. A sash side member is said to be slidably received by a track of a fixed jamb liner when at least one point along the sash side member is slidably received by a track in a fixed jamb liner.

In a preferred embodiment, the track 25 of the fixed jamb liner 24 receives a generally T-shaped pivot pin 27 that is connected to the balancer mechanism 29 which in turn is secured to the sash 32. Likewise, the track 31 receives a generally T-shaped pivot pin 33 that is secured to the balancer mechanism 35 which in turn is secured to the upper sash side member 30. The pivot pins 27 and 33 provide respective pivot points for the sash side members 32 and 30, respectively. FIG. 8 shows how the sash 32 can be pivoted around the pivot pin 27 when the latch 37 is manipulated to release the upper part of the sash 32 from the fixed jamb liner 24.

The end 39 of the latch 37 can be extended and retracted from the track 25. The end 39 is retracted from the track 25 by lifting the handle end 41 upward and away from the sash top rail 43. In this retracted position of the end 39, the sash can be tilted inward toward the interior of the room.

Because the fixed jamb liner 24 does not move laterally with respect to the frame jamb 22, the amount of friction in the vertical motion of the pivot pins 27 and 33 in the fixed jamb liner 24 is minimized. This results in a better sliding action of the sashes.

A hinged weatherstrip is a device having a rigid sash bearing member for sealing contact with a sash, and a second member for contacting the fixed jamb liner, wherein the sash bearing member is hingedly connected to the second member. A hinged weatherstrip provides a weather-tight seal between the fixed jamb liner and the sash such that air and water infiltration between the fixed jamb liner and the sash is reduced, if not eliminated.

Figure 2:
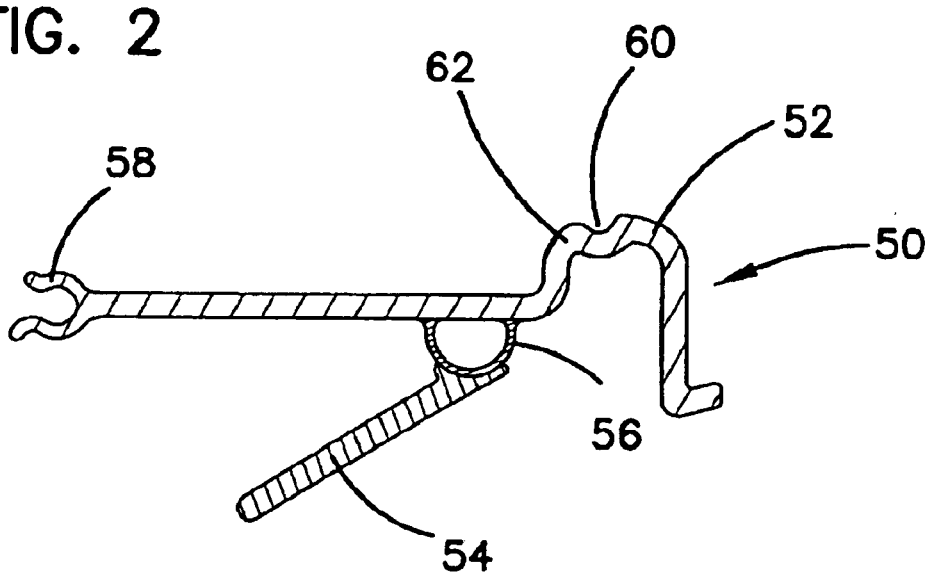
FIG. 2 is a cross sectional view of an alternative embodiment of a hinged weatherstrip.

A hinged weatherstrip may take on many different configurations. FIG. 2 illustrates a preferred embodiment of a hinged weatherstrip, specifically hinged weatherstrip 50. Hinged weatherstrip 50 extends the entire length of the fixed jamb liner 24. The sash 30 is configured to move up and down independently of the hinged weatherstrip 50. Hinged weatherstrip 50 includes the rigid sash bearing member 52 connected to the second member 54 by hinge element 56. Hinged weatherstrip 50 includes boot 58 for pivotal attachment to the fixed jamb liner as is described later. Hinged weatherstrip 50 also includes a pressure drop area 60 that will be described later.

The rigidity of the sash bearing member 52 provides certain advantages as compared to the use of a soft bulb type of weatherstrip or a pile type weatherstrip. The rigid sealing surface of the sash bearing member 52 provides durability that is not achievable with a soft surface. The rigid sealing surface also provides reduced friction when compared to a soft surface. It is also noted that the interaction of the sash bearing member 52 and the sash 30 provides improved tracking and stability of the sash during its sliding operation.

The hinged weatherstrip design also includes the further advantage of compression consistency and longevity that is not achievable with a soft surface type of weatherstrip. In other words, the compression of soft surface weatherstrips changes over time. The hinged weatherstrip, on the other hand, will consistently compress the necessary amount, even as the hinged weatherstrip ages.

Two alternative preferred embodiments of hinged weatherstrips are shown in the context of their operation in FIG. 1. Hinged weatherstrip 26 operates in conjunction with the upper sash side member 30 and hinged weatherstrip 28 operates in conjunction with the lower sash side member 32.

Hinged weatherstrip 26 is pivotally connected to the fixed jamb liner 24 by the frictional fit of boot 90 around knob 92. This arrangement allows the hinged weatherstrip 26 to pivot relative to the fixed jamb liner 24. Likewise, hinged weatherstrip 28 is pivotally connected to the fixed jamb liner 24 by the frictional fit of boot 91 on knob 96.

The lateral movement of the hinged weatherstrip 26 is confined by the interaction of the wing 94 of the hinged weatherstrip 26, in the direction away from the frame 22, and the knob 96 of the fixed jamb liner 24. Likewise, lateral movement of the hinged weatherstrip 28 is confined by the intersection of the wing 89, in the direction away from the frame 22, and the knob 92 of the fixed jamb liner 24. When the knobs 92 and 96 act as members for confining the lateral movement of the sash bearing member, they are also referred to as overhang members.

As can be seen in FIG. 1, the second member 98 contacts a hinged weatherstrip receiving surface 19 of the fixed jamb liner 24 resulting in a lateral force on the sash bearing member 100 against the sash 30. This lateral force ensures that the sash bearing member 100 is constantly in contact with the sash 30, except when the sash is in a tilted position. Likewise, second member 87 contacts the fixed jamb liner 24 resulting in a lateral force on the sash bearing member 102 against the sash 32.

Figure 4:
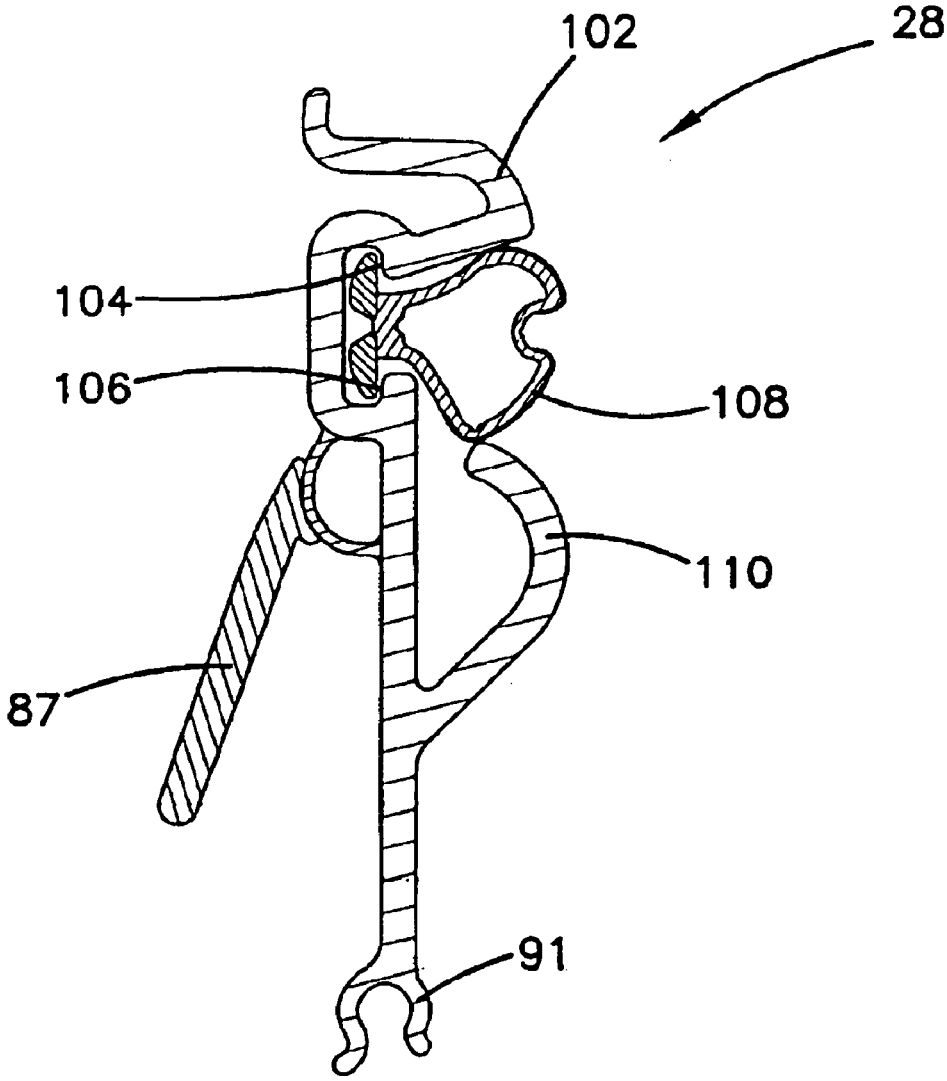
FIG. 4 is a cross sectional view of an alternative embodiment of a hinged weatherstrip.

The lower hinged weatherstrip 28 shown in FIG. 1 is also shown as a stand alone part in FIG. 4. In a preferred embodiment, the sash bearing element 102 of the lower hinged weatherstrip 28 includes a flexible bulb receiving slot formed by edges 104 and 106. A flexible bulb 108 made of a resilient material is received by the flexible bulb receiving slot in the sash bearing element 102. The flexible bulb extends lengthwise along the entire length of the sash side member 32 when the sash side member 32 is positioned in its downward most position (i.e., when the window is closed). The flexible bulb 108 provides additional water sealing between the hinged weatherstrip 28 and the lower sash 32. The flexible bulb 108 provides additional protection if there is sash bowing or damage to the sash (e.g. in the case that the sash is made of wood). The hinged operation between the sash bearing member 102 and the second member 87 still provides the durability and consistency of compression of the flexible bulb 108. Furthermore, the hinged operation between the sash bearing member 102 and the second member 87 also protects the flexible bulb 108 during tilting of the sash 32. The amount of compression on the flexible bulb 108 remains consistent because the compression rate of the flexible bulb 108 is less than the compression rate of the remainder of the hinged weatherstrip 28.

A hinged weatherstrip may also include a pile type strip attached to the sash bearing member in such a way to provide additional sealing capacity to the hinged weatherstrip. The pile type strip would preferably be attached in the same position as the flexible bulb 108.

A flexible bulb or pile weatherstrip is generally not required in association with the top sash because the contact area between the sash and the hinged weatherstrip is to the inside of the sash and is therefore protected from direct water spray.

The sash bearing element 102 of the hinged weatherstrip 28 includes a curved point 110 that makes contact with the flexible bulb 108.

A hinged weatherstrip receiving surface is a portion of a fixed jamb liner that is configured to receive contact with and force from a second member of a hinged weatherstrip. If a hinged weatherstrip includes a third member, then the hinged weatherstrip receiving surface includes the surface of the fixed jamb liner configured to receive contact with and force from the third member.

A hinged weatherstrip can be geometrically configured to create a pressure drop area for reducing the velocity of moisture and air that may be flowing or attempting to flow between the sash and the sash bearing element of the hinged weatherstrip. A pressure drop configuration is any shape in the sash bearing element of the hinged weatherstrip that creates an area of reduced pressure sufficient to reduce the velocity of infiltrating moisture.

Multiple embodiments of pressure drop configurations are disclosed here. FIG. 2 provides one embodiment of a pressure drop configuration that creates a pressure drop area 60. Specifically, the groove 62 in the sash bearing element 52 is a pressure drop configuration.

Figure 3:
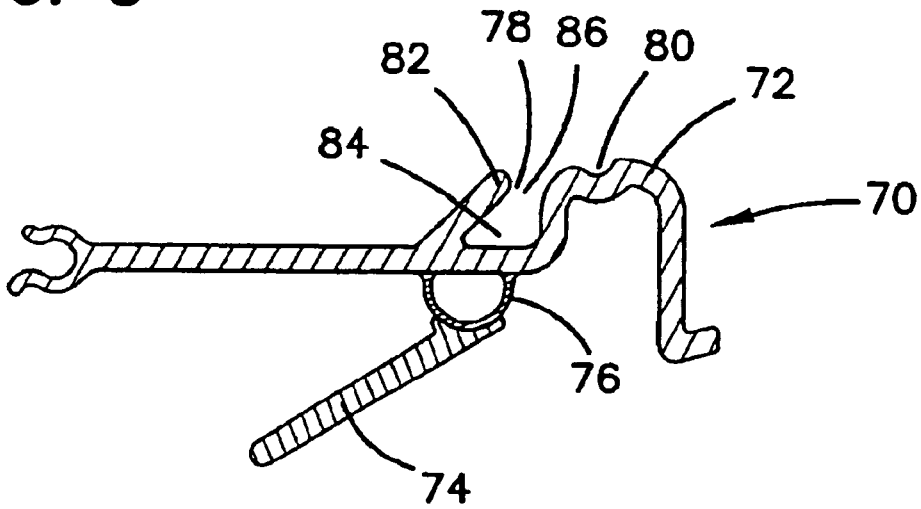
FIG. 3 is a cross sectional view of an alternative embodiment of a hinged weatherstrip.

The hinged weatherstrip 70 of FIG. 3 includes two pressure drop areas 78 and 80 formed by the sash bearing member 72. The point 82 creates a chamber 84 and a narrow passageway 86. The combination of the chamber 84 and a narrow passageway 86 creates the pressure drop area 78.

The hinged weatherstrip 26 in FIG. 1 also includes a pressure drop area 97. Pressure drop area 97 is created by the chamber 101 and narrow passageway 99 formed by point 103 in the sash bearing member 100.

Figure 5:
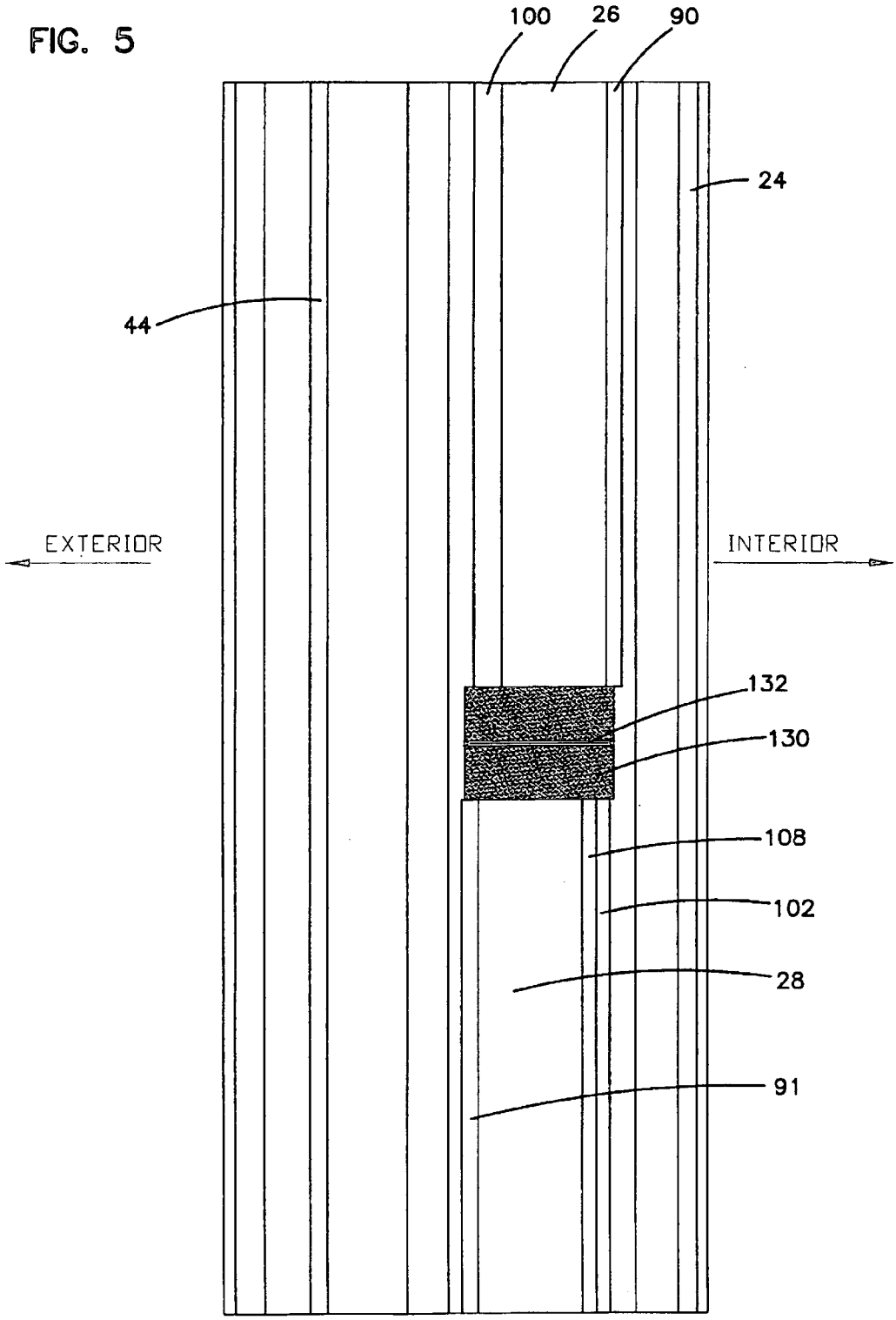
FIG. 5 is a side view of a preferred embodiment of a jamb liner, an upper hinged weatherstrip and a lower hinged weatherstrip.

FIG. 5 is taken along lines 5—5 in FIG. 1. FIG. 5 shows the fixed jamb liner, an upper hinged weatherstrip 26, a lower hinged weatherstrip 28, and a check rail pad 130 of a double hung window. The check rail pad 130 seals the space between the upper hinged weatherstrip 26 and the lower hinged weatherstrip 28. In a preferred embodiment, the check rail pad 130 includes two pile pads separated by a plastic fin seal 132. The pile pads are for preventing air infiltration and the plastic fin seal 132 are for preventing water infiltration.

Figure 6:
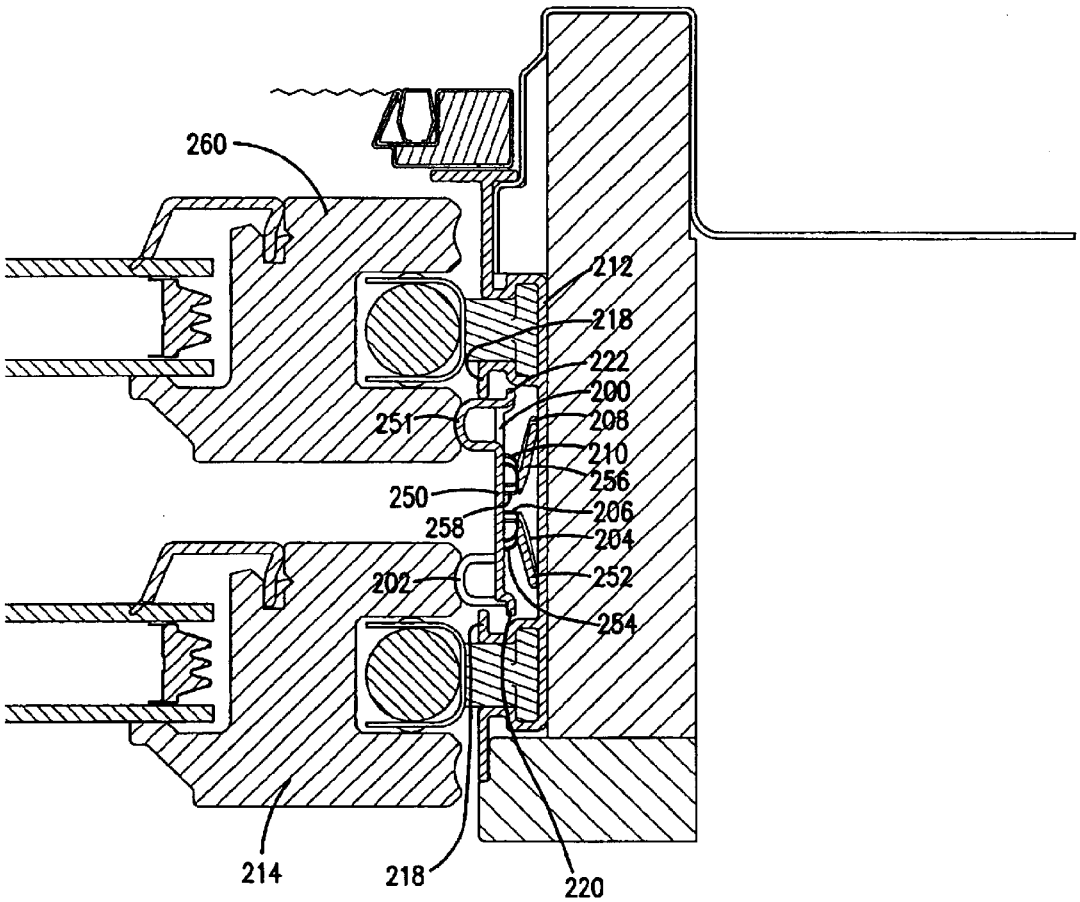
FIG. 6 is a cross sectional view of an alternative embodiment of a double hung window in a preferred embodiment of the invention.

FIG. 6 illustrates an alternative preferred embodiment of a fixed jamb liner 212 and a lower hinged weatherstrip 200 and an upper hinged weatherstrip 250. Specifically, the hinged weatherstrip 200 includes a sash bearing member 202 connected to a second member 204 via a hinge element 206 and also a third member 208 connected to the sash bearing member 202 by hinge element 210. Likewise, the upper hinged weatherstrip 250 includes sash bearing member 251 which is connected to second member 252 by hinge element 254 and to third member 256 by hinge element 258.

The hinged weatherstrips 200 and 250 do not include boots for pivotal interaction with the fixed jamb liner 212. Rather, in this embodiment the entire sash bearing member 202 and 251 are capable of lateral movement towards and away from the sash 214 and sash 260, respectively. The lateral movement of the sash bearing members 202 and 251 toward the sashes 214 and 260, respectively, is confined by the interaction of the overhang members 216 and 218 of the fixed jamb liner 212 with the wings 220 and 222 of the sash bearing member 202. The movement of hinged weatherstrip 250 is similarly confined.

Figure 7:
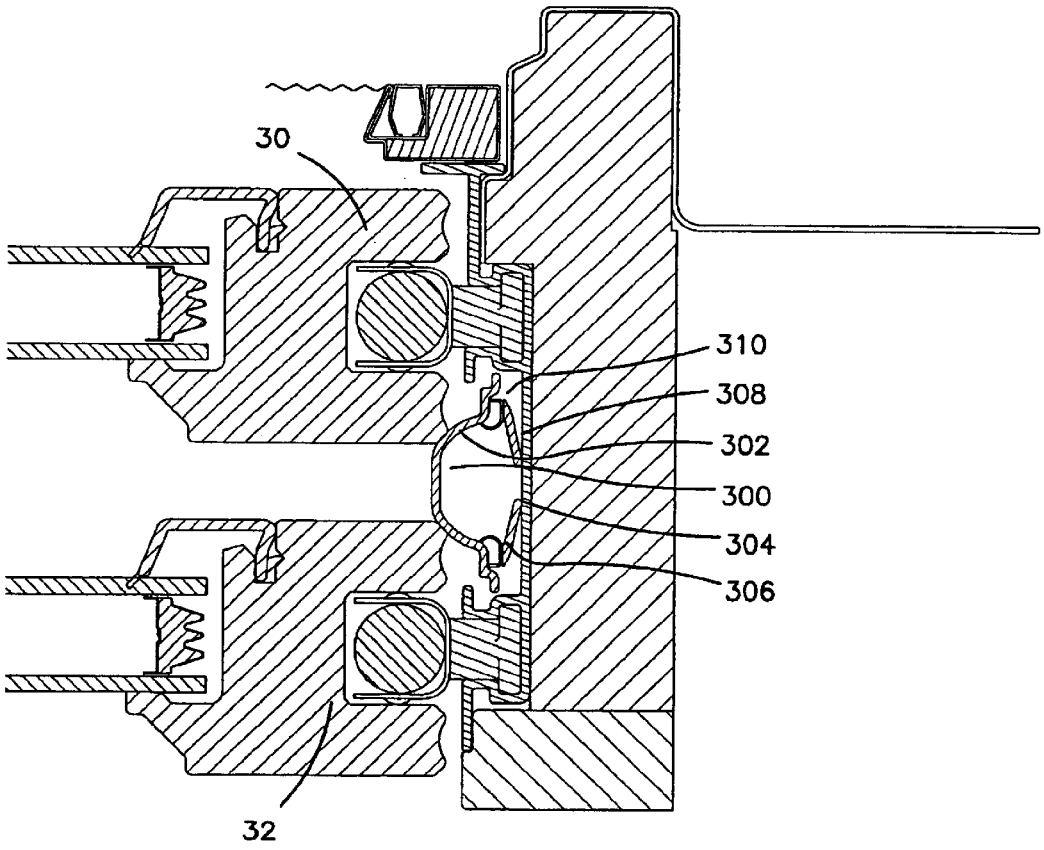
FIG. 7 is a cross sectional view of an alternative embodiment of a double hung window in a preferred embodiment of the invention.

Another preferred embodiment of a hinged weatherstrip is illustrated in FIG. 7. Specifically, hinged weatherstrip 300 includes sash bearing member 302 connected to second member 304 by hinge element 306, and sash bearing member 302 also connected to third member 308 by hinge element 310.

The sash bearing element of the hinged weatherstrip 300 is capable of contacting both the upper sash 30 and the lower sash 32 in a double hung window. Therefore, only a single hinged weatherstrip is required per side of a double hung window. In other words, there is one hinged weatherstrip on the right side and another hinged weatherstrip on the left side of the window.

An explanation of the balancer 29 is now provided. FIG. 9 is a perspective view of a preferred embodiment of the balancer 29 of this invention. A balancer is defined as being any mechanism that provides a biasing force to a window sash to at least partially counteract the force of gravity. The balancer could be a spring biased block and tackle mechanism or it could be some other mechanism such as a weight and pulley system.

In this preferred embodiment, the balancer 29 includes an elongated U-shaped housing 402 made of steel having a pair of parallel, laterally spaced side walls 404 and 406 and an outer wall 408 interconnecting the side walls 404 and 406 together. The housing 402 defines an elongated chamber 410. The housing is secured to a side of sash such as sash 32 by means of screw 413 which is held in place by fastening block 412 which in turn is fastened to the housing 402 by a press fit.

A coil spring 414 has a first end connected to a pin 416 by a hook that hooks around the pin 416. The pin 416 is riveted or otherwise fastened to the side walls 404 and 406 of the housing 402. The opposite end of the spring 414 is connected to a block and tackle 418. The block and tackle 418 includes a first pulley member 420 and a second pulley member 422 that are conventionally interconnected by a cord 401 that passes back and forth between the two pulley members. The cord has a first end that is connected to the block and tackle 418. The cord 420 exits the block and tackle 418 by extending around the circumference of a pulley wheel 426 that is adjacent second pulley member 422. In a preferred embodiment of the invention, the pulley wheel 426 is slightly elliptical in shape. Preferably, pulley wheel 426 is supported at its axis by a pin 428 that is supported by a plastic block 430 that is integral with second pulley member 422. The pulley wheel 426 changes the direction of the cord 401 by approximately 180 degrees. After this 180 degree turn, the cord extends parallel to the balancer 29 and a second end 419 of the cord 401 is anchored to the frame 468. The cord 401 is anchored to the frame 468 by attaching the cord 401 to anchor 470 as described above and then screwing the anchor 470 through the jamb liner 472 and into the frame 468 with screw 434.

The pivot pin 27 is made of plastic and is an integral part of the plastic block 430 and second pulley member 422. During normal vertical up and down movement of the sash in the frame, the pin 27 slides up and down with the sash in the groove 436 of the jamb liner 472. The large head 438 on the pin 27 prevents the pin from being removed from the groove 436. When the sash is tilted out of the plane of the frame, the tilt axis is along the line between the pin 27 and its counterpart pin (not shown) located on the opposite side of the sash near the bottom rail. The pivot pin 27, plastic block 430 and second pulley member 422 are one piece and this one piece is attached to the housing 402 by rivet pins 440 and 442 that extend through the second pulley member 422.

Figure 11:
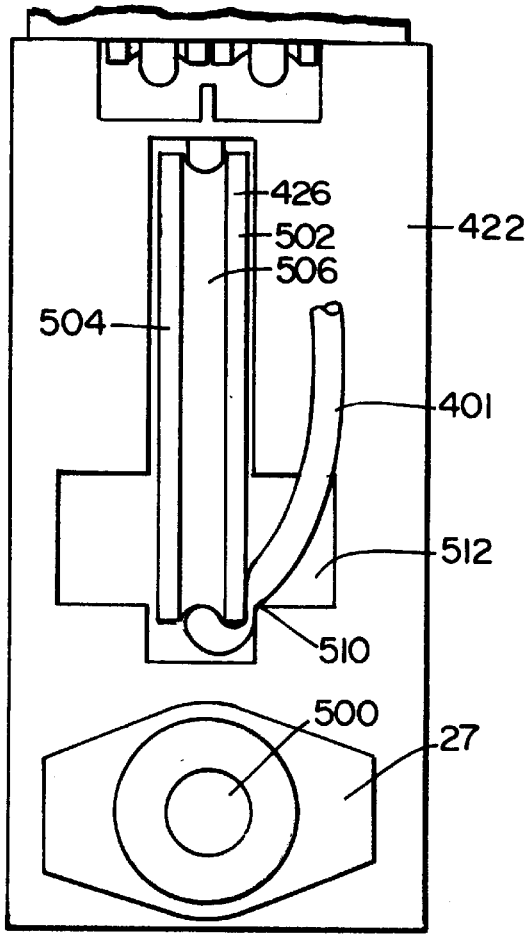
FIG. 11 is a magnified side view of a preferred embodiment of a latching mechanism of the invention with the cord in a second position.
Figure 10:
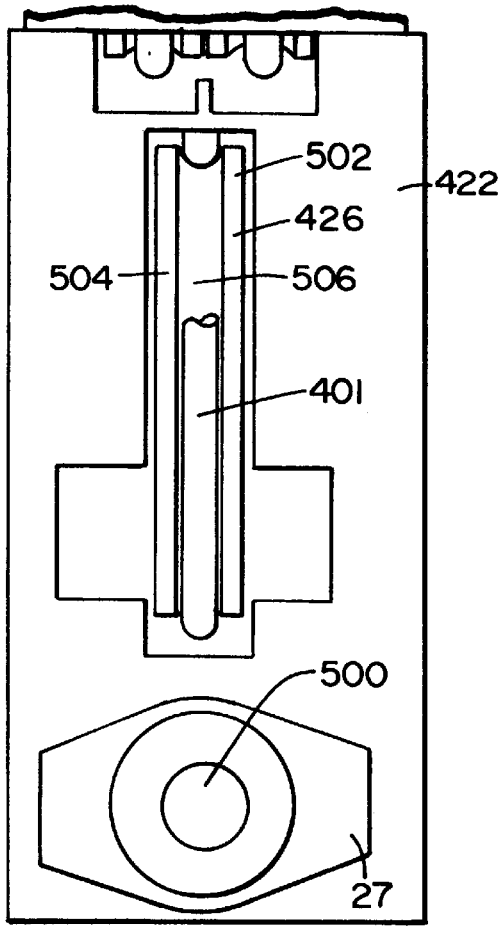
FIG. 10 is a magnified side view of a preferred embodiment of a latching mechanism of the invention with the cord in a first position.

FIGS. 10 and 11 are magnified views taken along the line 10—10 of FIG. 9. FIGS. 10 and 11 are described below to illustrate a preferred latching mechanism of this invention which prevents the window sash from moving vertically when in the tilted position. This latching mechanism is a part of the balancer 29 discussed above.

FIG. 10 illustrates one position of the cord 401 with respect to pulley wheel 426 and plastic block 422 that occurs when the sash 32 is in a vertical untilted position. FIG. 11 illustrates another position of the cord 401 with respect to the pulley wheel 426 and the plastic block 422 that occurs when the sash 32 is in its tilted position.

As can be seen in both FIGS. 10 and 11, the pulley wheel has a first and second circumferential edge portions 502 and 504 and a groove 506 between them. These circumferential edge portions have a larger radius than the groove 506. As shown in FIG. 10, when the sash is in its vertical position the cord 401 rides in the groove 506 and because of the circumferential edge portions 502 and 504 cannot be displaced out of the groove 506. When the sash 32 is in its vertical position, the cord 401 is extensible such that it may freely revolve partially around the pulley wheel 426. The extensible property of the cord in the position shown in FIG. 10 allows the sash to move vertically.

In FIG. 11, the cord 401 is pinched or caught between the circumferential edge portion 502 and the plastic block 422. This position of the cord 401 shown in FIG. 6 is caused by tilting the sash 32 relative to the frame. The second end 419 of the cord 401 is anchored to the frame and so the tilting action pulls the cord 401 out of the groove 506 and into a position in which it is between the pulley wheel and the plastic block 422. In the position shown in FIG. 11, the cord may not be extended in or out of the pulley wheel because the cord 401 is frictionally engaged between the pulley wheel 426 and the point 510. The plastic block 422 is preferably shaped as shown in FIGS. 10 and 11. The plastic block 422 includes a right angled point 510 and a recess 512. The recess 512 is located closer to the axis of the pulley wheel 426 than is the point 510. When the sash is tilted, the cord 401 is pulled into the recess 512 and necessarily between the circumferential edge portion 502 of the pulley wheel 426 and the point 510.

In a preferred construction of the present invention, the fixed jamb liners and the hinged weatherstrips are constructed of extruded polyvinylchloride. However, other materials can be used without departing from the spirit of this invention.

The above specification provides a complete description of the device of the invention. Since many embodiments of the invention can be made without departing from the spirit and scope of the invention, the invention resides in the claims hereinafter appended.

We claim:

1. A window comprising:

(a) a frame, first and second fixed jamb liners, a pair of sashes, and first and second hinged weatherstrips;

(b) the frame includes first and second vertical jambs, wherein each of the first and second jambs includes a receiving surface;

(c) each of the first and second fixed jamb liners includes an outer surface and an inner surface opposite the outer surface, wherein the outer surface of the first fixed jamb liner is secured to the receiving surface of the first jamb, wherein the outer surface of the second fixed jamb liner is secured to the receiving surface of the second jamb, and wherein the inner surface of each of the first and second fixed jamb liner includes a pair of tracks guiding the sashes, and wherein the inner surface of each of the first and second fixed jamb liners includes a hinged weatherstrip receiving surface disposed between said tracks;

(d) each of the first and second hinged weatherstrips includes a sash bearing member and a second member hingedly connected thereto, wherein each of the sash bearing members includes a first pressure drop area, wherein each said second member contacts the hinged weatherstrip receiving surface of a respective one of the fixed jamb liners and biases a respective one of said sash bearing members about a hinge axis towards a side of a respective one of said sashes; and (e) wherein the sashes are pivotable with respect to said jamb liners.

2. The window of claim 1 wherein the sash bearing members of each of the first and second hinged weatherstrips include a boot, wherein each boot is pivotally secured to a respective one of the first and second fixed jamb liners.

3. The window of claim 2 wherein each of the sash bearing members further comprise a wing at an end of the sash bearing member opposite the boot, and wherein each of the first and second fixed jamb liners further comprise an overhang member, wherein pivotal movement of each of the sash bearing members toward the side of the respective one of said sashes is constrained by contact of the wing with a respective one of the overhang members.

4. The window of claim 1 wherein each of the sash bearing members includes a second pressure drop area.

5. The window of claim 1 wherein the sash bearing member of the second hinged weatherstrip further comprises a flexible bulb receiving slot, wherein the second hinged weatherstrip further comprises a flexible bulb received by the flexible bulb receiving slot.

6. A fixed jamb liner and hinged weatherstrip assembly for use in a window having a frame jamb and a sash side member, the fixed jamb liner and hinged weatherstrip assembly comprising:

(a) the fixed jamb liner having an outer surface and an inner surface that is opposite the outer surface, wherein the outer surface is configured to be secured to the frame jamb, and wherein the inner surface includes a track for slidably receiving the sash side member, and wherein the inner surface includes a hinged weatherstrip receiving surface, and wherein the fixed jamb liner further comprises a knob;

(b) the hinged weatherstrip including a sash bearing member and a second member, wherein the sash bearing member comprises a first pressure drop area and a boot having a channel, and wherein the knob is pivotally secured in the channel, and wherein the sash bearing member is configured to contact the sash side member, and wherein the second member contacts the hinged weatherstrip receiving surface of the fixed jamb liner and biases said sash bearing member about said knob in a direction toward the sash side member.

7. The fixed jamb liner and hinged weatherstrip assembly of claim 6 wherein the sash bearing member further comprises a wing, wherein the wing is disposed at an end of the sash bearing member opposite the boot, and wherein the fixed jamb liner further comprises an overhang member, wherein pivotal movement of the sash bearing member in the direction toward the sash side member is constrained by contact of the wing with the overhang member.

8. The fixed jamb liner and hinged weatherstrip assembly of claim 6 wherein the sash bearing member further comprises a second pressure drop area.

9. The fixed jamb liner and hinged weatherstrip assembly of claim 6 wherein the sash bearing member further comprises a flexible bulb receiving slot, wherein the hinged weatherstrip further comprises a flexible bulb received by the flexible bulb receiving slot.

* * * * *